United States Patent [19]

Ogata et al.

[11] 4,192,662

[45] Mar. 11, 1980

[54] PROCESS FOR LIQUEFYING AND RECTIFYING AIR

[75] Inventors: Shunji Ogata, Machida; Yohei Yamamoto, Tokyo, both of Japan

[73] Assignees: Japan Oxygen Co., Ltd.; Tokyo Cryogenic Industries Co., Ltd., both of Tokyo, Japan

[21] Appl. No.: 863,889

[22] Filed: Dec. 23, 1977

[51] Int. Cl.[2] ..... F25J 3/04

[52] U.S. Cl. ..... 62/13; 62/18; 62/30; 62/40

[58] Field of Search ..... 62/40, 13–15, 62/18, 30, 29

[56] References Cited

U.S. PATENT DOCUMENTS

| | | | |
|---|---|---|---|
| 2,496,380 | 2/1950 | Crawford | 62/40 |
| 2,627,731 | 2/1953 | Benedict | 62/30 |
| 3,367,122 | 2/1968 | Tutton | 62/40 |
| 3,707,849 | 1/1973 | Becker | 62/40 |

*Primary Examiner*—Norman Yudkoff

*Attorney, Agent, or Firm*—Fisher, Christen & Sabol

[57] ABSTRACT

Separation of air to produce oxygen, nitrogen and other materials is done by liquefaction and rectification under low pressure to achieve a large saving of the power requirement. The cold of LNG (liquefied natural gas) is utilized for cooling feed air and compressed gas (principally nitrogen), and this gas is compressed at an extremely low temperature so as to achieve further saving of power.

6 Claims, 1 Drawing Figure

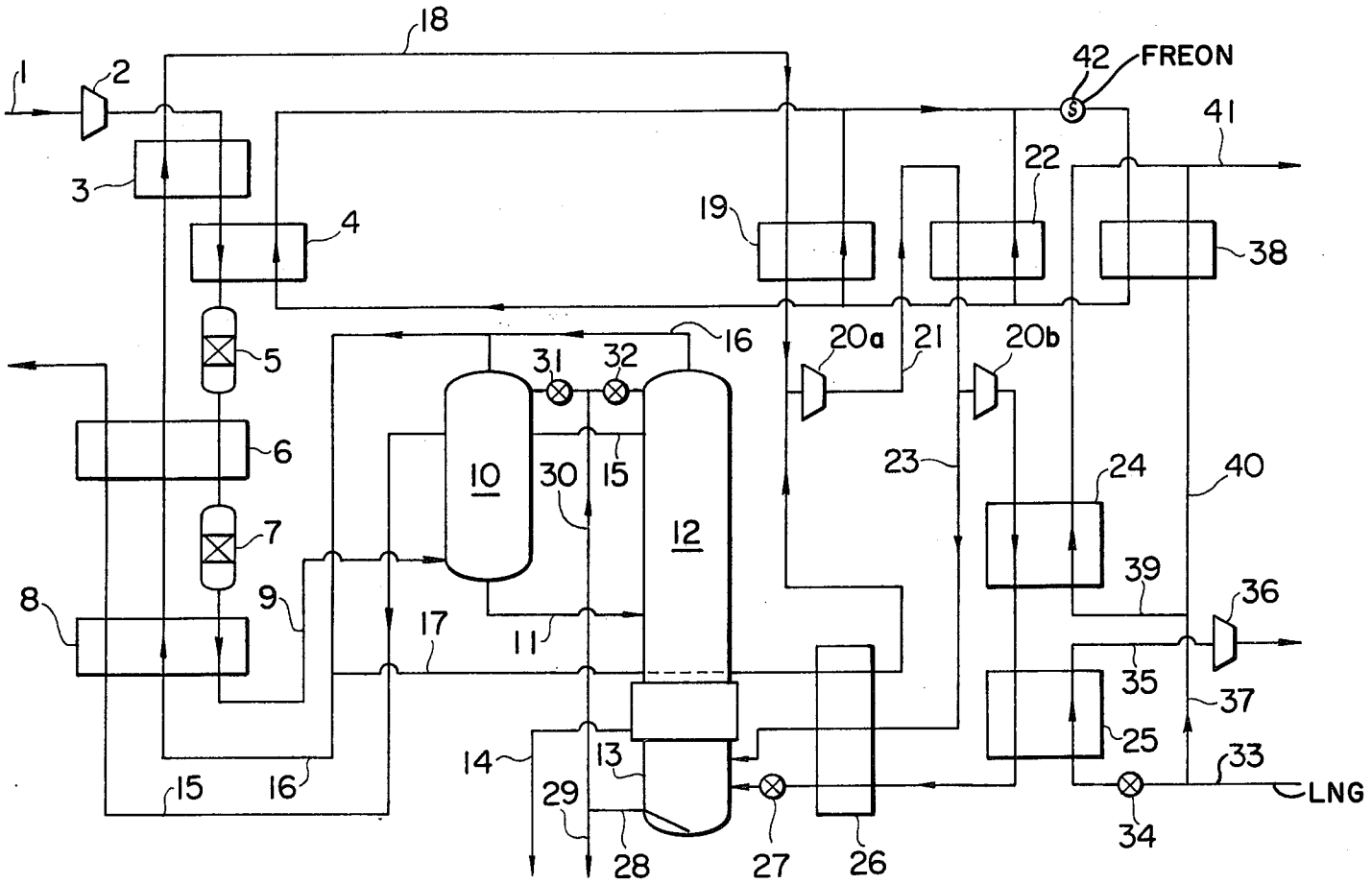
FREON
LNG
1
2
3
4
5
6
7
8
9
10
11
12
13
14
15
16
17
18
19
20a
20b
21
22
23
24
25
26
27
28
29
30
31
32
33
34
35
36
37
38
39
40
41
42

PROCESS FOR LIQUEFYING AND RECTIFYING AIR

BACKGROUND OF THE INVENTION

The invention under this application is aimed to enable substantial reduction of compression power required for air separation, that is, liquefaction and rectification of air to separate oxygen, nitrogen and other materials and in particular to extract them as liquid products.

Most of the costs to separate air into and extract oxygen, nitrogen and other materials are that of power, and most of this power is consumed to compress feed air. Therefore reduction of this compression power is immediately contributive to the amount of power per unit volume of the products. Various solutions have been proposed along this line e.g. utilization of the cold of LNG (liquefied natural gas), based on the fact that power to compress gas is reduced by lowering the inlet temperature of gas. However in a plant to produce, say 10,000 $m^3/h$ of oxygen, where feed air of five times as much as the product is required, the accrued saving is counterbalanced either (1) by a larger capital and power costs of adsorbing facilities to remove moisture, carbon dioxide and other impurities, which is necessary to avoid solidification in the process or (2) in a generally accepted method of cooling feed air and removing such impurities by the use of a regenerative cooler or a reversing heat exchanger, by a required level of feed air compression so as to enable removal of impurities. That is, removal of impurities by a regenerative cooler or a reversing heat exchanger requires in general the pressure of feed air to be 5 $kg/cm^2G$. This means that despite the use of LNG the power saving is not largely expected, and the contribution of the cold of LNG is limited to supplement cold energy in liquefaction/rectification stages.

SUMMARY OF THE INVENTION

The present invention has been proposed in order to overcome the above-mentioned defects, and has for its object to compress circulating nitrogen to a pressure which is a rectifying column pressure of about 0.5 $kg/cm^2G$, oxygen is separately evaporated in this rectifying operation, whereby the compression of feed air is carried out at a pressure where feed air can still be fed into the rectifying step. That is to say, since the circulating nitrogen is compressed to transmit the cold of the LNG and expanding to a pressure for evaporating oxygen in the rectifying operation which is provided by a portion of the separated nitrogen instead of compressing air, the supply air can be merely blow instead of compressing the same. And, the compression of the circulating nitrogen can be effected at an extremely low temperature of about −140° C. by making effective use of the cold of LNG; resulting in a marked reduction in the power. The present invention is illustrated, merely by way of example, in the accompanying drawing which is a flow chart showing one embodiment according to the invention.

DETAILED DESCRIPTION OF THE INVENTION 31,800 $m^3/h$ of feed air enters air compressor (2) through piping (1) where it is compressed to 1.2 $kg/cm^2G$. Upon removal of heat of compression in heat exchanger (3) the air is introduced into heat exchanger (4). This heat exchanger (4) is cooled by a part of freon which is cooled by LNG and circulates in a closed cycle as described later. The cooled air then enters adsorbent-charged adsorber (5) for moisture removal and to heat exchanger (6) cooled by the separated, low-temperature nitrogen gas. After passing through heat exchanger (6), the air goes into adsorbent-charged adsorber (7) for removal of carbon dioxide, is further cooled in heat exchanger (8) and led through piping (9) to the first rectifier (10). This first rectifier (10) corresponds to a high pressure tower in a conventional plant and is operated at approximately 0.5 $kg/cm^2G$, whereas a conventional pressure tower is usually operated under pressure of 4.5 $kg/cm^2G$. This means that the necessary pressure for compressing feed air is such that the air can virtually reach the rectifying process after passing through the pretreatment stages necessary for rectification.

The feed air is rectified in this first rectifier (10), so that nitrogen is separated to the upper part of the column and oxygen rich liquid air to the lower. For further rectification, the oxygen-rich liquid air is sent to second rectifier (12) through piping (11). Second rectifier (12) is operated under generally the same pressure as first rectifier (10), so that nitrogen is separated at the upper part of the column and liquid oxygen above condenser (13) at the lower part. 6,000 $m^3/h$ of liquid oxygen thus produced is extracted as product from piping (14).

On the other hand, a part of nitrogen separated to the upper part is extracted through piping (15), cools feed air by counter-flowing in heat exchangers (8) and (6) and is consequently warmed and discharged. Nitrogen extracted through piping (16) joins nitrogen coming out from the top of first rectifier (10). A part of this nitrogen goes to piping (17). The remainder is brought into countercurrent contact with feed air in heat exchangers (8), (6) and (3) for cooling, so that it is warmed to almost a normal temperature. This nitrogen, through piping (18), is then cooled down to −140° C. in heat exchanger (19) which constitutes a part of the freon cooling cycle, and after joining the flow of nitrogen in piping (17), it enters nitrogen compressor (20*a*) where the nitrogen is compressed to 5 $kg/cm^2G$. This compressed nitrogen is introduced through piping (21) into heat exchanger (22) constituting a part of the freon cycle like in the case of heat exchanger (19), where it is cooled to −132° C. A part of this gas is separated to piping (23). The remainder is compressed to 30 $kg/cm^2G$ in nitrogen compressor (20*b*)and then goes through heat exchangers (24) and (25) where it is cooled by LNG. It is further supercooled in heat exchange with the separated, low-temperature nitrogen having been bypassed to piping (17) in heat exchanger (26), expanded to 5 $kg/cm^2G$ through expansion valve (27) and is introduced into condenser (13) in second rectifier (12). The flow of nitrogen of 5 $kg/cm^2G$ at −132° C., which is bypassed into piping (23), is introduced into condenser (13) through heat exchanger (26). The two flows of nitrogen are condensed so that liquid nitrogen is collected at the bottom of condenser (13). This liquid nitrogen is extracted by piping (28) and 6,000 $m^3/h$ is collected as a product through piping (29). The remainder is expanded to 0.5 $kg/cm^2G$ through expansion valves (31) and (32) and is refluxed into the first and second rectifiers (10) and (12).

LNG is supplied through piping (33). A part of it is expanded through expansion valve (34) and is introduced into LNG heat exchanger (25) to cool compressed nitrogen of 30 kg/cm$^2$g. LNG per se is gasified and leaves through piping (35), and is compressed to a proper pressure in compressor (36) for supply as gaseous fuel or feedstock. The rest of LNG is separately supplied to LNG heat exchanger (24) and freon heat exchanger (38) by way of piping (39) and (40) respectively, and impart its cold to compressed nitrogen and freon in those heat exchangers, whereby this LNG per se is again gasified and flows into piping (41) for supply as gaseous fuel or feedstock.

Reference numeral (42) in the diagram is a freon circulating pump. Freon is cooled by LNG in freon heat exchanger (38) and is separately introduced into heat exchangers (22), (19) and (4). The warmed freon joins together and returns to circulating pump (42).

While this example shows the first and second rectifiers, it is possible to eliminate the first rectifier by feeding air directly into the middle of the second rectifier.

As seen from the above description, this invention has many characteristic features which are not found in the existing facilities, and an appropriate combination of such features leads to a considerable reduction in the power. For instance, a conventional plant is generally designed to compress feed air to 5 kg/cm$^2$G and rectify the compressed air at 4.5 kg/cm$^2$G in a pressure tower followed by further rectification at about 0.5 kg cm$^2$G; hence, there is a limit on the possibility of reduction in the pressure of feed air. However, pressure for compressing feed air under the invented process may be only such that the air is made to reach the rectifying stage through pretreatment stages, since the rectifiers operate only at about 0.5 kg/cm$^2$G. This is achieved by designing that nitrogen circulation via condenser (13) performs the function of reboiling in a conventional pressure tower and also by making effective use of the cold of LNG. In addition, the effective use of the cold of LNG renders it possible to compress the circulating nitrogen at an extremely low temperature in the order of about −140° C. This also serves to reduce power requirement which is not attainable in the known process. In this connection, a comparison is made between this and conventional processes, i.e., in the case of process in which LNG is not employed, power consumption per unit liquid product is about 2 KWH/Nm$^3$, whereas it is about 0.76 KWH/Nm$^3$ in the case of the usual process but in which LNG is used and feed air is compressed to 5 kg/cm$^2$G. However, the process according to the present invention gives this unit of about 0.5 KWH Nm$^3$. This is a reduction of about 58% with the first case and 34% with the second. In addition, the lower rectifying pressure gives the higher efficiency of separation and also makes it possible to save the capital cost.

Since the pressure for compressing feed air is set at a low pressure of 1.2 kg/cm$^2$G in this invention, removal of impurities contained in the air is done by adsorbents rather than by cooling by a regenerative cooler, a reversing heat exchanger, etc. This gives no demerit in the facilities but instead, because of the merits as discussed above, it enables larger extraction of nitrogen product. Extracting oxygen and nitrogen as liquid products has been exemplified here, but it is possible to collect them as gaseous products. In addition, it goes without saying that the utilization of the cold of LNG can be expanded to replace the freon cycle by making simple modifications to the design.

It will be obvious to engineering experts upon a study of this application that this invention permits a variety of modifications in structure and arrangement and hence can be given design other then particularly illustrated and described herein, without departing from the essential features of the invention within the scope of the following application.

What is claimed is:

1. In a process for separating air by liquefaction and rectification to produce liquid oxygen and liquid nitrogen as main products, wherein in such processes the cold of liquefied natural gas is used, the improvement comprising the steps of:

(a) compressing feed air to a low pressure at which the air can still be fed into a rectification step;

(b) cooling said feed air in a non-reversing heat exchanger by heat exchange with low-temperature gas which is obtained from separation of said feed air, said low temperature gas being (1) nitrogen or (2) nitrogen and oxygen in separate process lines;

(c) removing water and carbon dioxide impurities contained in said feed air by adsorptive purification;

(d) cooling said purified feed air by heat exchange with low temperature gas which is obtained from separation of said feed air, said low temperature gas being (1) nitrogen or (2) nitrogen and oxygen in separate process lines;

(e) separating said cooled feed air from step (d) into nitrogen and oxygen at approximately atmospheric pressure by liquefaction and rectification to provide at least liquid oxygen which is removed as a product, said rectification including refluxing and reboiling;

(f) warming a portion of said nitrogen which is obtained in separation step (e) by heat exchange with said feed air;

(g) cooling the said portion of the nitrogen by heat exchange with freon which has been cooled by liquefied natural gas;

(h) compressing said cooled nitrogen to a pressure higher than a pressure required for reboiling at a low temperature in said rectification step (e), the pressure of compressed nitrogen in step (h) being enough to liquefy the nitrogen by heat exchange with the cold of liquefied natural gas transmitted to said compressed nitrogen, and (i) cooling further said compressed nitrogen by heat exchange with the liquefied natural gas to liquefy the nitrogen;

(j) expanding said compressed and cooled liquid nitrogen until a pressure required for reboiling at low temperature in said rectification step (e) is achieved;

(k) circulating said expanded liquid nitrogen which is obtained from step (i) as a heat source for reboiling and withdrawing a portion of said liquid nitrogen as said reflux in step (e) and as a product, wherein said compressing step (h) is done at the lower inlet temperature to reduce the power of said compression.

2. A process for liquefying and rectifying air as claimed in claim 1 wherein said rectification step (e) is effected at a pressure of about 0.5 Kg/cm$^2$G and wherein the separated, low-temperature gas in steps (b) and (d) is nitrogen gas.

3. A process for liquefying and rectifying air as claimed in claim 1 wherein the nitrogen separated in rectification step (e) is compressed at lowest to about minus 140° C. as inlet temperature of the compressor in step (h).

4. A process for liquefying and rectifying air as claimed in claim 3 wherein the pressure of the nitrogen in compressing step (h) is about 30 $Kg/cm^2G$.

5. A process for liquefying and rectifying air as claimed in claim 3 wherein the nitrogen separated in step (e) is compressed by two stages in compressing step (h), and a portion of the nitrogen which is compressed in the first stage of compressing step (h) is compressed in the second stage of compressing step (h).

6. A process for liquefying and rectifying air as claimed in claim 1 wherein the pressure of the expanded nitrogen in expanding step (j) is about 5 $Kg/cm^2G$.

* * * * *

UNITED STATES PATENT OFFICE

CERTIFICATE OF CORRECTION

Patent No. 4,192,662 Dated March 11, 1980

Inventor(s) Shunji Ogata et al.

It is certified that error appears in the above-identified patent and that said Letters Patent are hereby corrected as shown below:

In the heading insert:

--[30] Foreign Application Priority Data

December 28, 1976 Japan.....--51-159585 --

Signed and Sealed this

*Twenty-fourth* Day of *June 1980*

[SEAL]

*Attest:*

SIDNEY A. DIAMOND

*Attesting Officer* *Commissioner of Patents and Trademarks*